United States Patent [19]

Gallup et al.

[11] Patent Number: 4,552,512

[45] Date of Patent: Nov. 12, 1985

[54] STANDBY WATER-POWERED BASEMENT SUMP PUMP

[75] Inventors: William Gallup, Palatine; Detleff W. P. Schmidt, Schaumburg, both of Ill.

[73] Assignee: Permutare Corporation, Palatine, Ill.

[21] Appl. No.: 525,121

[22] Filed: Aug. 22, 1983

[51] Int. Cl.[4] ..... F04B 41/06; F04B 49/00; F04B 17/00; F04C 2/00

[52] U.S. Cl. ..... 417/3; 417/41; 417/46; 417/405; 418/267

[58] Field of Search ..... 417/2, 3, 6, 36, 40, 417/47, 405–407, 426, 41, 46, 85, 286, 287; 418/267

[56] References Cited

U.S. PATENT DOCUMENTS

| | | | |
|---|---|---|---|
| 958,345 | 5/1910 | Wilkin | 418/15 |
| 1,016,017 | 1/1912 | Koltschanoff | 418/15 |
| 1,042,980 | 10/1912 | Shawver | 417/46 |
| 1,804,604 | 5/1931 | Gilbert | 418/15 |
| 1,942,570 | 1/1934 | Reed | 417/406 X |
| 2,020,956 | 11/1935 | Norling | 417/406 |
| 2,357,334 | 9/1944 | Kendrick et al. | 418/267 X |
| 2,632,398 | 3/1953 | Ferris | 418/267 |
| 2,688,287 | 9/1954 | Burrows et al. | 418/267 X |
| 3,121,528 | 2/1964 | Rhodes | 417/407 |
| 3,211,104 | 10/1965 | Rosaen | 418/268 X |
| 3,276,384 | 10/1966 | Jekat et al. | 417/406 X |
| 3,411,449 | 11/1968 | Murdoch | 417/406 X |
| 3,614,276 | 10/1971 | Erdmann | 418/266 X |
| 3,820,924 | 6/1974 | Cassidy | 418/267 X |
| 3,910,728 | 10/1975 | Sloan | 417/405 X |
| 3,963,376 | 6/1976 | Miskin | 417/40 |
| 4,060,341 | 11/1977 | Tremain et al. | 417/182.5 |
| 4,183,352 | 1/1980 | Spencer | 126/432 |
| 4,184,808 | 1/1980 | Cobb | 417/348 |
| 4,222,711 | 9/1980 | Mayer | 417/36 X |
| 4,419,056 | 12/1983 | Ege | 417/53 X |
| 4,422,829 | 12/1983 | Buchanan | 417/40 |

*Primary Examiner*—William L. Freeh
*Assistant Examiner*—Paul F. Neils
*Attorney, Agent, or Firm*—Kenway & Jenney

[57] ABSTRACT

A water-powered positive displacement auxiliary sump pump has a drive water inlet connected to the municipal water supply via a float actuated pilot valve. The pump is designed to be constructed chiefly of molded plastic supported by an exit manifold connected to the discharge line of an existing electrical sump pump. The presently preferred design is a rotary sliding vane pump having drive water and pump water chambers.

19 Claims, 12 Drawing Figures

FIG. 1
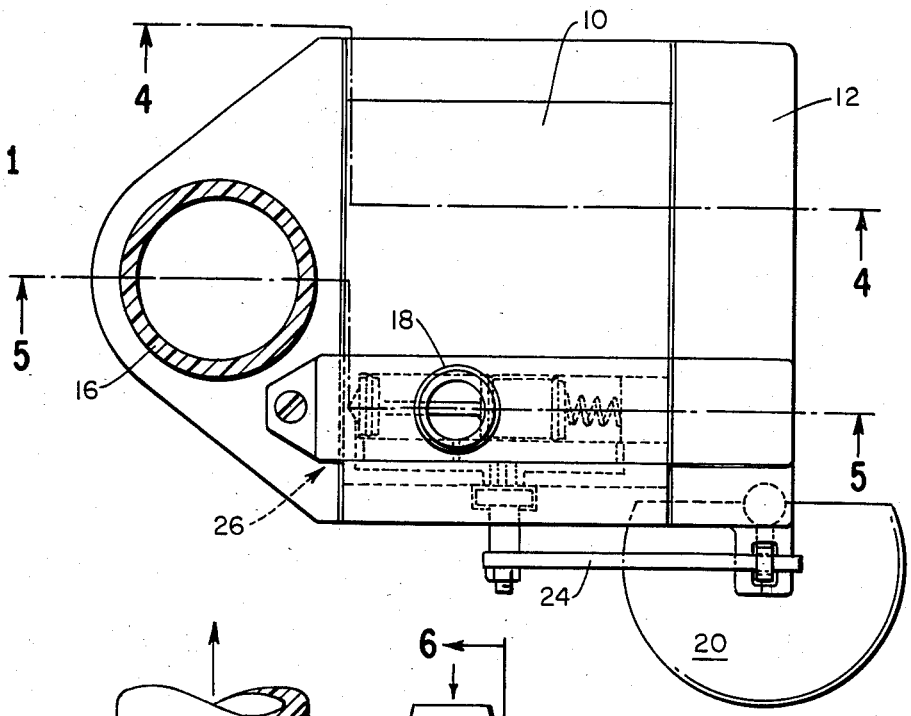
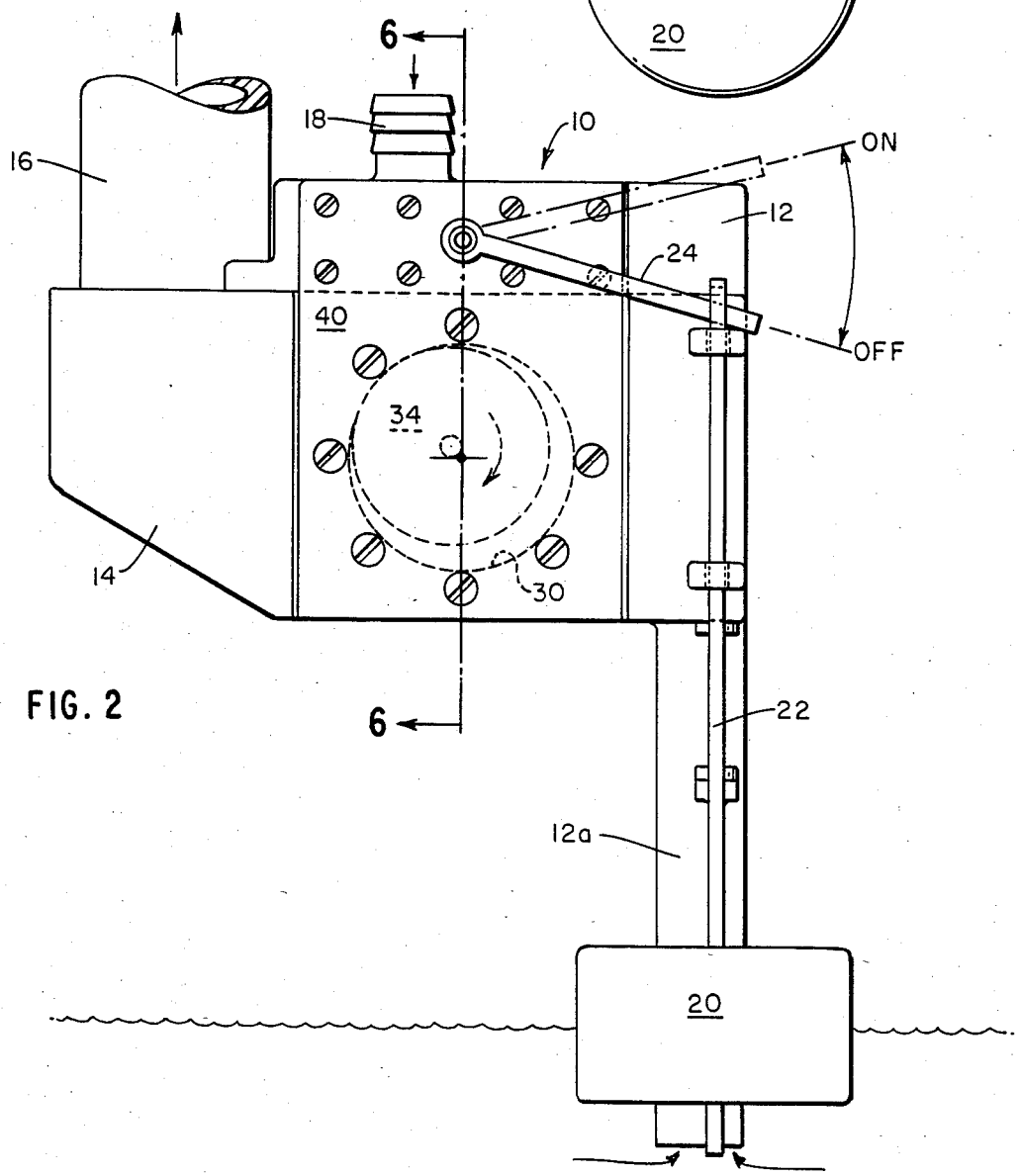
FIG. 2

FIG. 5
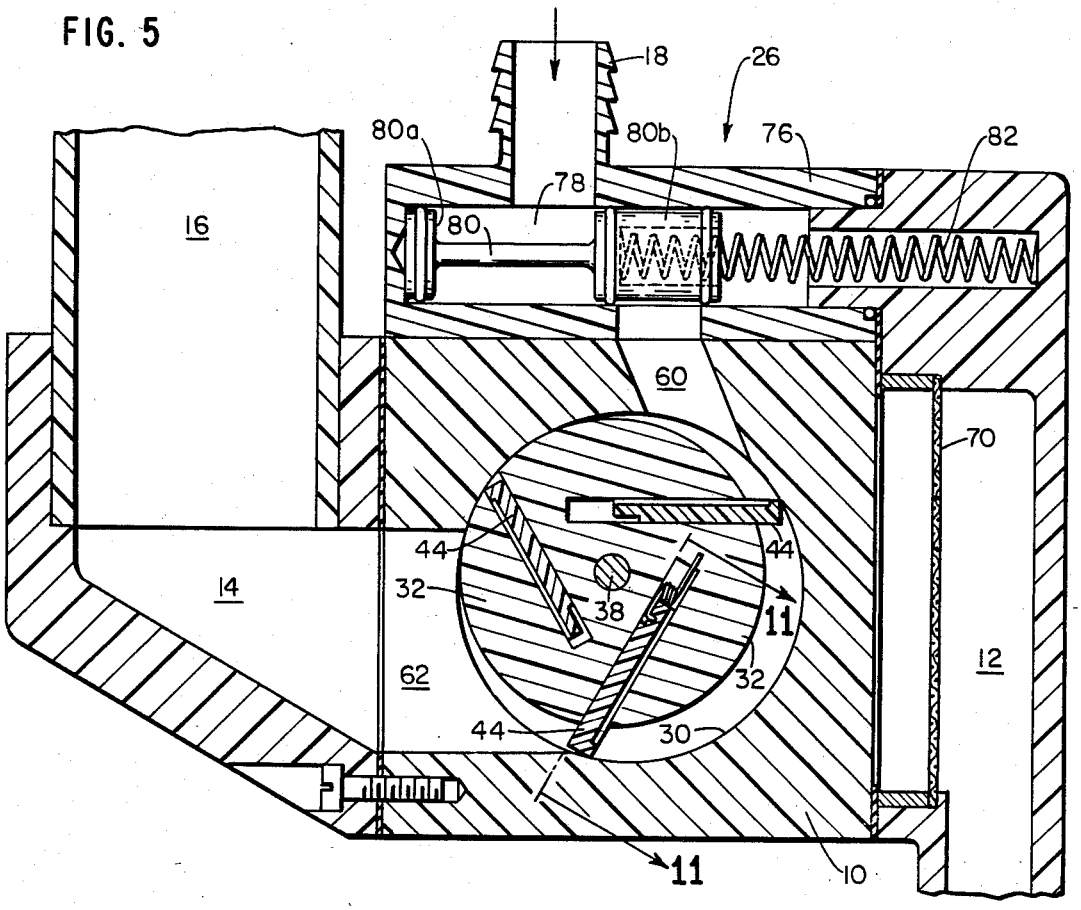
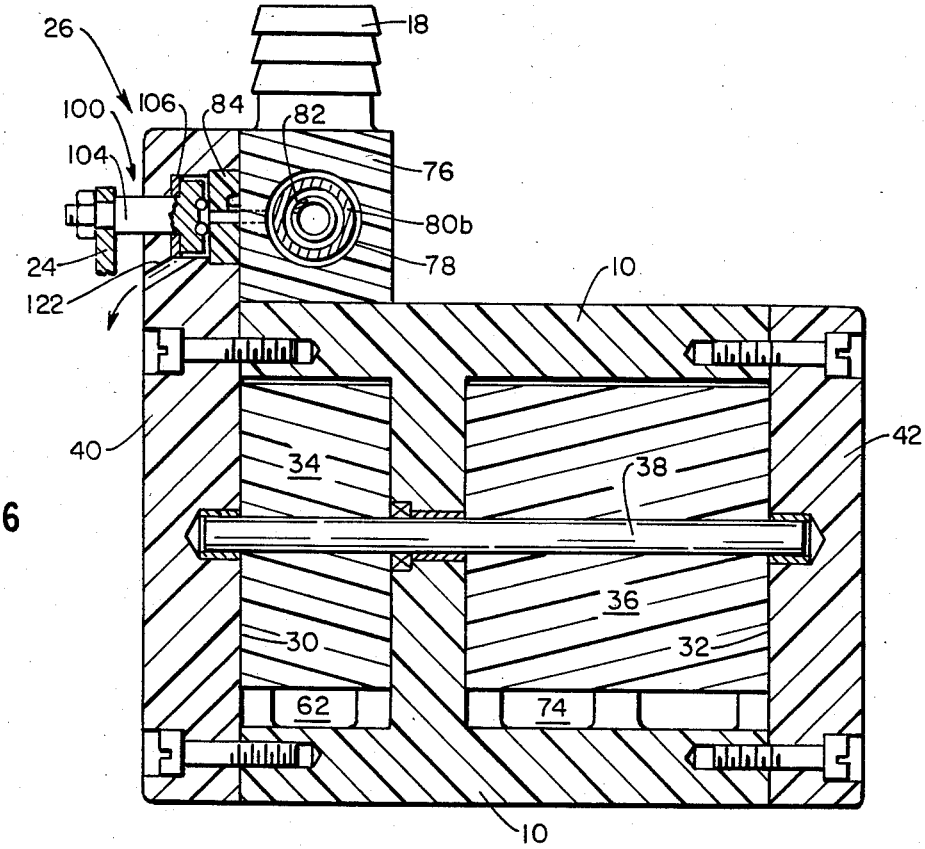
FIG. 6

FIG. 7
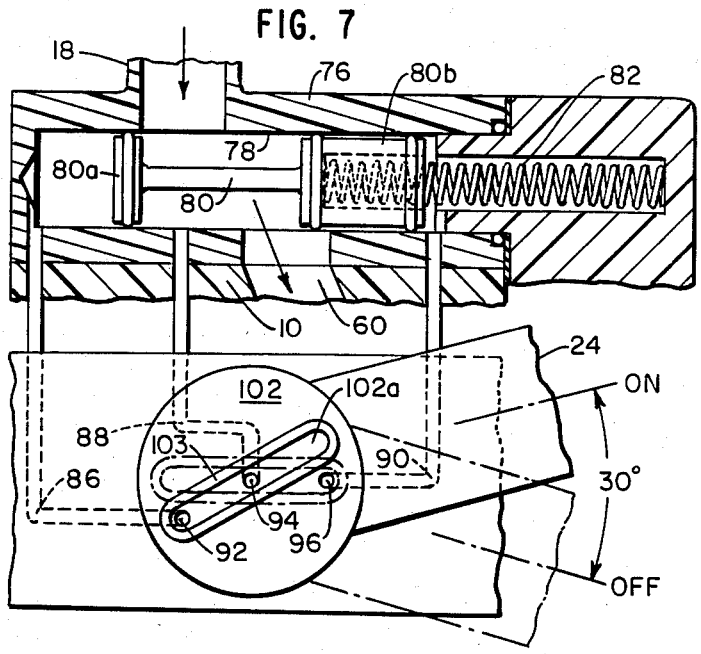
FIG. 9
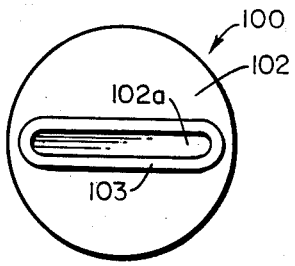
FIG. 8
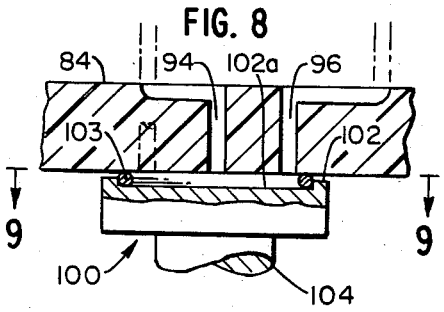
FIG. 10
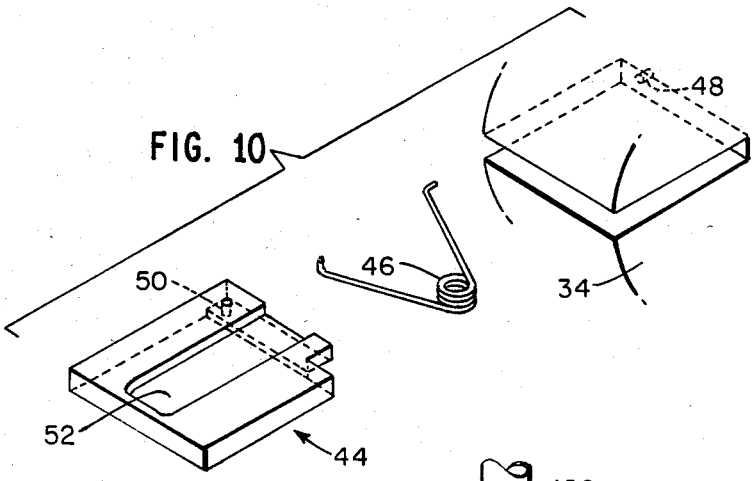
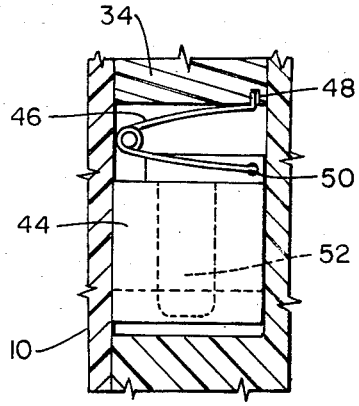
FIG. 11
FIG. 12
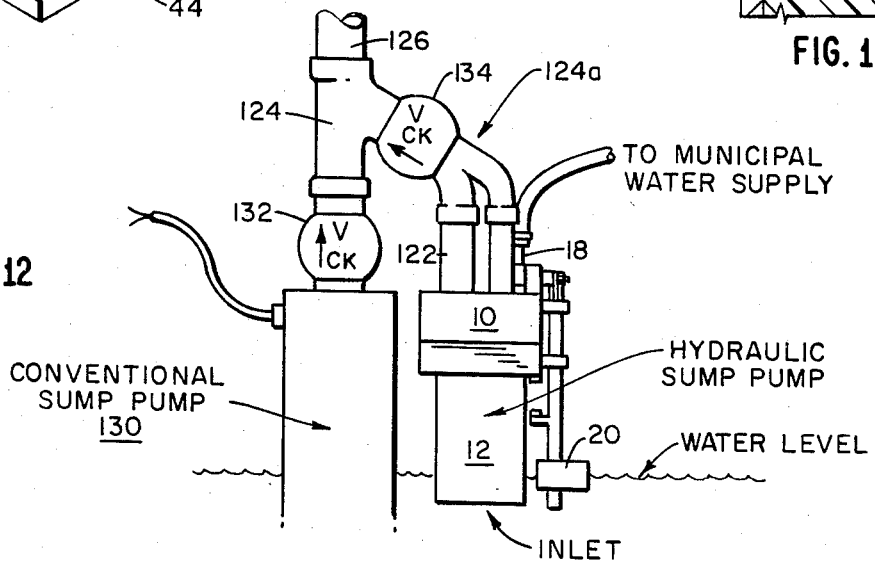

STANDBY WATER-POWERED BASEMENT SUMP PUMP

BACKGROUND OF THE INVENTION

The invention relates generally to the subject of flood water removal and in particular to automatic sump pumps.

Flooded basements are a frequent enough occurrence in many areas that sump pumps are necessary. The typical basement sump pump comprises a submersible impeller type pump disposed in a well-like hole or sump formed through the basement floor. The pump is powered by an electrical motor connected to house current. The water outlet or exit tube of the pump extends upward and out through an opening in an adjacent basement wall. The water pumped from the basement rarely exits more than ten feet above the inlet of the pump. Literally millions of such sump pumps are installed throughout the United States. However, many do not have sufficient capacity to remove incoming flood water. Thus, the flood level continues to rise despite the operation of the sump pump. All of them share the same vulnerability to an electrical power failure. Occurrences of power failures, while rare, frequently accompany violent storms and flooding. Thus, existing sump pumps can be woefully inadequate when flooding is accompanied by even a temporary outage or when flood waters rapidly intrude upon a low-lying area with an unusually high water table.

In the past, the only safeguards available have been expensive backup systems. A battery backup system with a DC motor pump is expensive and typically has sufficient battery capacity for removal of only on the order of 7,000 gallons. If flooding continues and the batteries are depleted, the backup system is effectively nonexistent. Gas powered generators for supplying backup electrical power are extremely expensive and like all combustion engines, require periodic maintenance.

Without adequate protection from existing sump pump installations, homeowners in areas plagued by habitual basement flooding are constantly imperilled by the threat of serious water damage for which adequate insurance coverage is usually unavailable.

SUMMARY OF THE INVENTION

Accordingly, the objective of the present invention is to provide a low cost auxiliary basement-type sump pump which will back up an under capacity system already installed and will operate in the event of a power failure.

A correlary object of the invention is to provide a basement flood water removal system which is powered by nonelectrical energy so as to operate independently of electrical service.

These and other related objects of the invention are achieved by the standby water-powered auxiliary sump pump system according to the present invention. A positive displacement pump has a drive water inlet permanently connected to the municipal water system. The drive water inlet is connected via a float actuated pilot valve to a hydraulic pump. The pump itself preferably consists of a drive chamber and a sump water chamber connected to a submersible intake which extends into a sump in the basement floor. The outlets of the drive and sump water chambers of the pump are connected to a pipe leading upwards and out of the basement. Preferably, the same exhaust pipe is used for the existing sump pump and the auxiliary pump according to the invention.

In the preferred embodiment, the two chambered pump is a rotary vane pump having two coaxial rotary pistons with slidable centrifugally forced veins which sealably slidingly engage the inside of aligned eccentric cylindrical chambers. The drive chamber is preferably smaller than the sump chamber by a factor of 2 to achieve a 2:1 water removal capacity. The pilot valve employs a spring loaded double acting cylinder valve activated by a pivoting oval seal. The sliding frictional surface contact area of the pilot valve is minimized to assure positive actuation by the float. In the ON condition, a magnet on the float assures hysteresis operation to achieve abrupt turn-off.

The preferred embodiment is constructed chiefly of molded nonhydroscopic plastic sufficiently lightweight to be suspended by plastic tubing connected to the exit pipe installed with the existing sump pump or supported by a spider floor support mounted over the sump well.

In low lying high water table areas with municipal water service, the auxiliary water pump of the present invention can be installed alongside an existing electrically powered sump pump to supplement insufficient capacity during rapid flooding conditions as well as to protect against the effects of a power failure during which the novel hydraulic pump can be called upon to operate for an indefinite period unlike the prior art backup systems.

BRIEF DESCRIPTION OF THE DRAWING

FIG. 1 is a plan view of the sump pump according to the invention showing the pilot valve in phantom;

FIG. 2 is a front view of the pump of FIG. 1 in elevation showing the rotary pistons and ON position of the valve crank in phantom;

FIG. 5 is a cross-sectional view of the pump taken along lines 5—5 of FIG. 1 showing the drive chamber, pilot valve and common exit manifold;

FIG. 6 is a longitudinal sectional view of the pump taken along lines 6—6 of FIG. 2;

FIG. 7 is a partially diagrammatic and sectional view of the valve of FIG. 5 in the alternate ON condition showing the OFF condition of the pivot body and crank in phantom;

FIG. 8 is an enlarged partially diagrammatic plan view partially in section of the pilot valve;

FIG. 9 is a plan view of the face of the valve pivot body taken at lines 9—9 of FIG. 8;

FIG. 10 is an exploded isometric view of the slotted rotor and vane assembly;

FIG. 11 is a plan view of a vane in a rotor slot taken at lines 11—11 of FIG. 5; and FIG. 12 is a schematic representation of a dual sump pump installation according to the invention.

DESCRIPTION OF THE PREFERRED EMBODIMENTS

Figure 3:
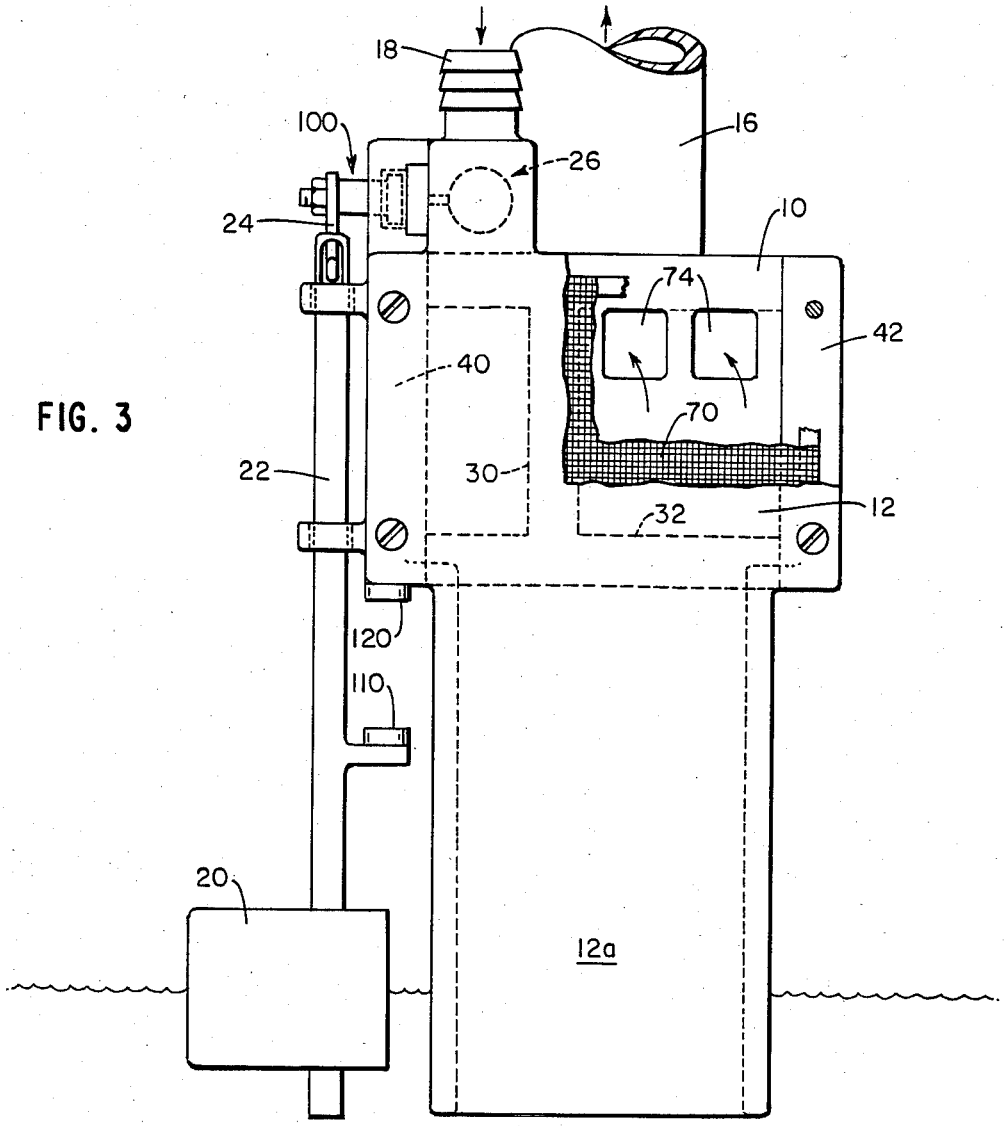
FIG. 3 is a side view of the pump of FIG. 1 in elevation with a portion of the intake manifold broken away to reveal the pump inlet.

A water-powered basement type sump pump constructed according to the invention is shown in FIGS.

1-3. The pump comprises a generally rectangular main pump body 10 situated between an intake manifold 12 having a downwardly extending sump water intake 12*a* and an exit manifold 14 connected to an upwardly extending outlet pipe 16. Municipal water, the motive force for the pump, is supplied to the pump body 10 via inlet 18 adapted to be engaged by a water hose and hose clamp (see FIG. 12) connected to a convenient faucet or *plumbed* directly into the residential cold water supply line. A float actuation assembly for turning the pump on when the water level rises comprises a float 20 adjustably secured to the end of rod 22 vertically slidably mounted to the outside of the intake manifold 12. The upper end of rod 22 is pivotally connected to crank 24 to actuate a pilot valve 26.

The pump mechanism of the present embodiment comprises a dual chambered water-powered rotary vane pump. As shown in FIG. 6, pump body 10 is formed with a pair of coaxial cylindrical chambers 30 and 32. The smaller chamber 30 located directly below the municipal water inlet 18 comprises the drive section of the pump. The other chamber 32 is roughly twice as long as the drive chamber and comprises the pump section through which the sump water is moved. Cylindrical rotary piston bodies 34 and 36 having the same diameter, smaller than the diameter of the cylindrical chambers are mounted respectively in the chambers 30 and 32. The pistons 34 and 36 are keyed for rotation on a coaxial axle 38 extending in parallel and eccentric to the cylindrical chambers 30 and 32. For ease of assembly, the axle 38 may be split and appropriately keyed or otherwise directly coupled so that the axles and pistons rotate together. The central bushing and seal for the axle 38 is located in the partition between the two chambers while the ends of the axle 38 extend into a drive chamber end cap 40 and a pump chamber end cap 42 secured to opposite sides of the pump body 10. Pistons 34 and 36 are to be tangent with the inside of the respective cylindrical chambers. To obtain a larger contact area between the piston and the cylinder, a land (not shown) may be formed in the side wall of the cylinder radiused to conform with the circumference of the piston.

The drive piston 34 carries three vanes 44 slidably received in transverse nonradial slots formed in the piston as shown in FIGS. 5 and 10. The axial width of the vanes approximates the length of the cylindrical drive chamber 30. Each vane has a square outer end with a gently radiused edge which is urged into sealing contact with the inside wall of the drive cylinder by a torsion spring 46 having one end anchored in a corresponding hole 48 in the slot in the piston 34 and the other end received in a hole 50 formed in an undercut rear portion of the vane 44. A cutout channel 52 is formed in the other face of each vane 44 to allow water pressure to assist in urging the vane into contact with the cylindrical wall and to vent the slot. Under rotation, of course, centrifugal force also tends to urge the vanes outward.

As shown in FIG. 5, an inlet channel 60 for drive water admits water under pressure to the interior of the drive chamber 30 from the inlet 18 via the pilot valve 26. On the other side of the chamber 30, a drive water outlet channel 62 is formed in the pump body 10 communicating the interior of the drive chamber 30 with the exit manifold 14. The inlet 60 and outlet 62 are always separated by at least one sealing the vane 44.

Figure 4:
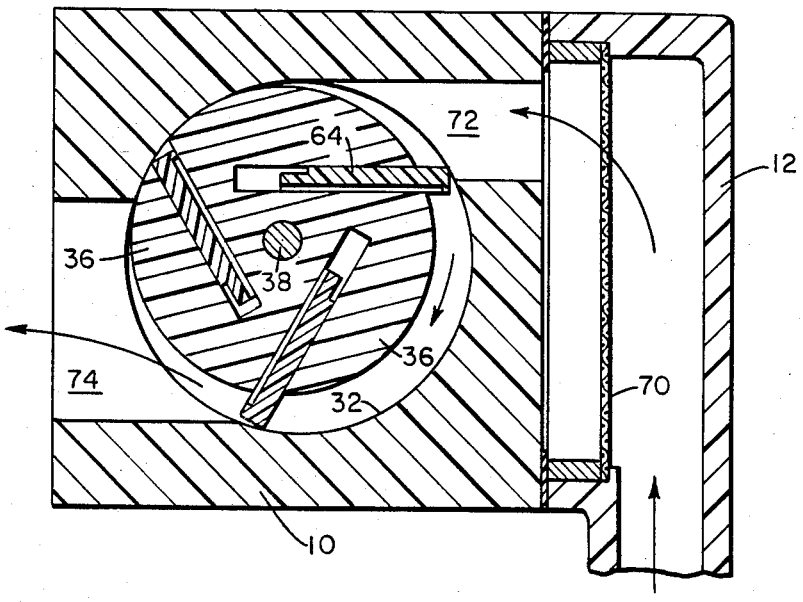
FIG. 4 is a cross-sectional view of the pump taking along lines 4—4 of FIG. 1 in the direction of the arrows showing the pump chamber.

As shown in FIG. 4, the piston 36 in the pump chamber 32 is similarly equipped with three vanes 64. Vanes 64 are coextensive with the longer axial dimension of the pump chamber 32 and differ further from vanes 44 in that each of vanes 64 has a pair of cutout channels 66 formed in the opposite face. Likewise, each vane carries a pair of springs arranged like springs 46 in the drive chamber, to urge the wider vanes into sealing contact with the cylinder 32.

Sump water is drawn into pump chamber 32 through the intake manifold 12 via a filtering screen 70 through an inlet channel 72 formed in the body 10. Outlet channel 74 in body 10 communicates the exhaust side of the pump chamber 32 to the common exit manifold 14.

As shown in FIGS. 5, 6 and 7, the pilot valve 26 comprises a valve housing 76 secured to the top of the pump body 10 directly above the drive chamber 30. The valve housing 76 is preferably formed integrally with the municipal water inlet 18. An elongated cylindrical valve chamber 78 is formed in the valve housing 76 intersecting the inlet 18. In offset opening in the floor of the valve housing 76 communicates the interior of the cylindrical chamber 78 with inlet 60 to the drive chamber 30. Valve piston assembly 80 is sealably received in cylindrical chamber 78. Piston 80 is a spool-shaped member having an O-ring seal on the left hand end as seen in FIGS. 5 and 7 and a pair of parallel O-ring seals on the larger right hand end. The right hand end portion of the piston 80 receives an axial compression spring 82 to slightly bias the piston toward the left as shown in FIG. 5. When the piston 80 is fully to the left, the home position, the larger double sealed end 80*b* occludes the opening to inlet 60 thus blocking the passage of municipal drive water into the drive chamber. When the valve piston 80 travels to the right, the larger end 80*b* no longer blocks the inlet 60 and municipal water is free to flow through the valve 24 from inlet 18 past the intermediate narrower portion of the piston 80 and into the inlet channel 60.

The pilot valve 26 operates as a double acting cylinder. As shown in FIG. 7, three ports are formed through the valve housing 76 at either end of the cylinder 78 and between the ends at the inlet 18. A manifold plate 84 is clamped in a matching recess in the end plate 40 in face to face contact with the valve housing 76 and extending alongside the cylinder 78. The manifold plate 84 has three matching through-holes 86,88 and 90 aligned with the ports in the left end, middle (water inlet) and right end portions of the cylinder 78. These respective through-holes 86, 88 and 90 are connected by channels formed in the face of the plate 84 against the housing 76 to corresponding through-holes 92, 94 and 96 noncolinearly juxtaposed in the middle of the manifold plate 84.

A pivot body 100 (FIGS. 6–9) is received through the end cap 40 and has an enlarged cylindrical end juxtaposed with the middle of the manifold plate 84. The end face 102 of the cylindrical end of pivot body 100 has an oval recess 102*a* into which an O-ring 103 is deformed as shown. Only the O-ring itself contacts the face of the manifold plate 84. The pivot body is designed to connect the juxtaposed through holes 92 and 94 or 94 and 96 depending on whether the pump is ON or OFF. The pivot body has a coaxial integral shaft 104 which extends outwardly through Teflon thrust washer 106 (FIG. 6) and the end cap 40 and is keyed to the crank 24.

In operation, whether due to power failure or to insufficient capacity of a conventional electric sump pump, rising sump water lifts the float 20 thereby rotating crank 24 to the upper position shown in phantom in FIG. 2. After reaching this level, an optional magnet 110 carried by the rod 22 contacts an opposing magnet or a piece of steel 120 attached to the underside of the manifold 12. The attraction between elements 110 and 120 should be sufficient only to allow the pump to stay ON until the water level again drops well below the float at which point the weight of the float, rod and crank assembly overcomes the force of the magnet. This arrangement makes the pump to turn off abruptly by forcing the pilot valve to the full OFF position as shown in FIG. 5.

When in the ON position as shown in FIGS. 7—9, the oval recess 102*a* connects through-holes 92 and 94. Municipal water pressure is communicated via through-hole 88 and 94 through their interconnecting channel to through holes 92 and 86 via their interconnecting channel to the left hand end of the cylinder 78 to apply pressure to the face 80*a* of the piston. Meanwhile, the right hand end of the cylinder 78 is vented through port 122 in the end cap via through holes 90 and 96 and their interconnecting channel in the plate 84.

When the piston 80 travels fully to the right, the inlet 60 to the drive chamber is opened. Municipal water enters the drive chamber via inlet 60 and acts against vane 44 thus applying torque to the rotor assembly which rotates like a paddle wheel. The spent drive water is exhausted through outlet 62 into the common exit manifold 14. In the other chamber, the coupled pump piston 36 sucks water through the sump intake manifold 12 through the filtered inlet 72 and into the pump chamber 32. The sump water is expelled via outlet 74 into the common exit manifold.

When the water level falls below the float 20, the weight of the float actuation assembly finally overcomes the magnet and abruptly turns crank 24 to the normal OFF position in which the pivot body oval O-ring is as shown in phantom in FIG. 7. In this condition, the right hand end of the cylinder 78 is communicated with the municipal water pressure while the left assists hand end is free to discharge through port 122. Spring 82 assists the piston in overcoming the effect of the water flowing through the inlet into the drive chamber to help close the pilot valve.

In opening the pilot valve, initially full water pressure is used to move the valve piston to the right; as water starts to flow into the pump, the pressure at inlet 18 decreases and the valve piston 80 comes to equilibrium with the spring 82 acting against it from the other direction. Essentially, the spring is necessary because it is easier to open the valve than it is to close it because the back pressure is significantly less. Once water is flowing into the pump from the municipal supply, the pressure available to operate the double acting cylinder is lower and must be reinforced by the spring to effect closure. It should be noted, however, that the spring's primary function is only to help overcome sticking friction. Thus, the spring is chosen to give as small a force as possible. A heavier spring would not allow the valve piston to open as far, thus reducing the flow into the drive side of the pump. It is also important to size the components and choose materials for the O-rings and valve housing 76 that result in the lowest possible back pressure and friction respectively.

As the coupled pistons rotate, the vanes alternately reciprocate in their slots. The cutouts 52 allow water to enter the back of the vane to assist in urging the vane against the cylindrical wall and also allow water to escape when the vane is pushed into the slot. Because the pressure on the pump side in chamber 32 is greater at the outlet 74, the orientation of the cutouts 52 is reversed so that they face the high pressure side (the outlet) of the pump. A bushing and seal in the partition between the chambers surround the drive shaft.

If desired, the outlet from the drive and pump chambers can remain separate. As shown in FIG. 12, pump body 10 is equipped with a dual exit manifold leading to pipes 121 and 123. The entire pump assembly can be suspended from a specially designed coupling 124 connected into the outlet riser 126 from a conventional electrically powered sump pump installation 130. Coupling 124 includes a two branch side arm 124*a* connected respectively to the drive outlet 121 and sump outlet 123. The conventional pump installation 130 is typically equipped with a one-way check valve 132 which prevents the return of sump water in the event of a power failure or malfunction of the electrical pump. In addition, the auxiliary pump outlet should also be equipped with its own check valve 134.

The disclosed pump operates as an effective supplement and safeguard against malfunction, power failure inadequate capacity of a conventional electrically powered sump pump. Aside from the springs, vanes, screws and magnets, the entire pump can be constructed from molded plastic components reducing the weight and cost to a small fraction of that formerly required for sump pump backup systems. Moreover, the disclosed pump will operate indefinitely so long as the municipal water supply has pressure sufficient to turn the rotor. A pump of the type disclosed herein has been constructed and tested and found to have more than enough capacity for 2:1 water removal to an elevation of at least ten feet. The pump is designed chiefly as a standby pump which would be called upon only in emergency. However, because of the float and pilot valve mechanism, it is completely automatic and can remain plumbed into the water system permanently. The water-powered backup sump pump system will prove to be a valuable, low cost safeguard in the low lying areas with high water tables served by municipal water supplies with standard pressure.

Many variations and modifications of the present embodiments are possible without departing from the spirit and scope of the invention. For example, while a rotary vane pump is disclosed herein, other types of pumps such as gear pumps and bladder pumps suitable for hydraulic drive may be adequate. Gear pumps in particular may be superior to the rotary vane embodiment and can be implemented with a similar dual chamber approach. The exact volumetric ratio between the drive and pump chambers may also be varied as can many of the other details and features of the invention such as the specific design of the float actuated pilot valve. In addition, if it is desired to separate municipal and sump water at the exit end of the pump, dual manifolds can be used for discharge via separate lines.

In any event, the foregoing embodiment is intended merely to be illustrative of one desirable implementation without being restrictive as to the scope of the invention, which is indicated by the appended claims and equivalents thereto.

What is claimed is:

1. A municipal water-powered auxiliary basement sump pump system for backing up a residential electric sump pump installation having an existing discharge line, comprising a water-powered rotary vane pump having a drive chamber and a pump chamber, slotted drive and pump rotors with a plurality of slidable vanes received therein sealingly engaging the inside walls of the respective chambers, means for drivingly coupling said drive rotor to said auxiliary pump rotor to impart rotation thereto, said drive chamber having a drive water inlet displaced from a drive water outlet, said auxiliary pump chamber having a sump water intake displaced from a sump water outlet, valve means for communicating said drive water inlet with a municipal water supply in response to the sump water level exceeding a predetermined threshold, exit manifold means for connecting said sump water outlet and said drive water outlet to said existing discharge line of the residential electrical sump pump, and intake manifold means for supplying said auxiliary pump intake with sump water.

2. The system of claim 1, wherein said valve means includes a float, a chamber having a municipal water valve inlet and a valve outlet connected to the motor inlet, a two position movable element sealingly received in said chamber, said element having means for blocking fluid communication between the inlet and outlet of said chamber in one position but not in the other position, and pilot valve means responsive to the actuation of said float for urging said element from one position to the other by applying a water pressure differential to said element.

3. The system of claim 1, further comprising rigid coupling means interposed between said exit manifold means and said discharge line for supporting the weight of said pump.

4. The system of claim 1, wherein said pump further includes means for resiliently urging said vanes into contact with the inside of said chambers in addition to centrifugal force.

5. The system of claim 4 wherein the length of the pump chamber is greater than the length of the drive chamber.

6. The system of claim 1, wherein said rotor coupling means includes a common drive shaft secured coaxially to said rotors.

7. The system of claim 6, wherein said rotors are the same diameter.

8. The system of claim 7, wherein said chambers are coaxial, cylindrical and have the same diameter and are separated by a partition through which said drive shaft is sealingly received in eccentric relation to the axis of the cylindrical chambers.

9. The system of claim 7, wherein said drive rotor vanes are equipped with cutout channels which terminate short of the chamber contacting edge of the vane facing the drive water inlet so as to be acted upon by water pressure from the drive water inlet and to allow water to egress from the rotor as the vanes are pushed inward, the pump rotor vanes having cutout channels terminating short of the chamber contacting edge of the vane facing the sump water discharge outlet so as to be acted upon by the pressure in the discharge line and to allow egress of water from the rotor when the vanes are pushed inward.

10. The system of claim 1, wherein said valve means includes a float, a double acting cylinder valve means having an elongated chamber and a piston sealingly received in said chamber and slidable between an ON and an OFF position, said chamber having a municipal water valve inlet and a valve outlet offset therefrom and connected to the motor inlet, said piston having means for blocking said motor inlet in the OFF position, auxiliary power valve means linked to said float for communicating one end of said chamber with said municipal water supply valve inlet and discharging the other end to move said piston from said OFF to the ON position in which said valve inlet and outlet are substantially unobstructed.

11. The system of claim 10, wherein said valve means further includes means for spring biasing said piston to the OFF position.

12. The system of claim 11, wherein said auxiliary pilot valve means includes a manifold surface with three juxtaposed holes, duct means for connecting a first one of said holes to said municipal water supply valve inlet to said chamber, and a second and a third one of said holes to respective ends of said chamber, a pivot body having an elongated chamber with resilient sealing means surrounding the periphery of said chamber in face-to-face contact with said surface so as to encompass and communicate either said first and second holes or said first and third holes depending on whether said pivot body is in the ON or OFF position, means responsive to said float level for rotating said pivot body to the ON orientation when said sump water exceeds the threshold or the OFF position when said sump water falls substantially below said threshold.

13. The system of claim 12, wherein said valve chamber is cylindrical and said piston includes a pair of cylindrical members having outer diameters approximately the same as the inner diameters of the adjacent cylindrical chamber axially spaced from each other but rigidly interconnected, one of the cylindrical ends of said piston having an axial length sufficient to occlude the valve outlet only in the OFF position.

14. The system of claim 12, wherein said valve means further includes means for maintaining said float at the ON position until the water level has dropped substantially below the normal buoyancy level of said float, whereby the pivot body is brought abruptly to the OFF position when the float drops.

15. A municipal water-powered auxiliary sump pump system for backing up a residential electrical sump pump installation having an existing discharge line, comprising a positive displacement water pump having an outlet and a submersible sump water intake, means for connecting said auxiliary sump pump water outlet to the existing discharge line of the residential electrical sump pump, hydraulic motor means drivingly coupled to said auxiliary pump having a drive water inlet for converting water pressure to mechanical energy to power said auxiliary pump, and valve means for communicating said drive water inlet with a municipal water supply in response to the sump water level exceeding a predetermined threshold, wherein said valve means includes a float, a chamber having a municipal water valve inlet and a valve outlet connected to the motor inlet, a two position movable element sealingly received in said chamber, said element having means for blocking fluid communication between the inlet and outlet of said chamber in one position but not in the other position, and pilot valve means responsive to the actuation of said float for urging said element from one position to the other by applying a water pressure differential to said element.

16. A municipal water-powered auxiliary sump pump system for backing up a residential electrical sump pump installation having an existing discharge line, comprising a positive displacement water pump having an outlet and a submersible sump water intake, means for connecting said auxiliary sump pump water outlet to the existing discharge line of the residential electrical sump pump, hydraulic motor means drivingly coupled to said auxiliary pump having a drive water inlet for converting water pressure to mechanical energy to power said auxiliary pump, and valve means for communicating said drive water inlet with a municipal water supply in response to the sump water level exceeding a predetermined threshold, wherein said valve means includes a float, a double acting cylinder valve means having a chamber and a piston sealingly received within said chamber and slidable between an ON and an OFF position, said chamber having a municipal water inlet and a valve outlet offset from said inlet connected to said motor means drive inlet, said piston having means for blocking the chamber outlet to said motor inlet in the OFF position, and auxiliary pilot valve means linked to said float for alternately communicating one end of said chamber with said municipal water supply and discharging the other end to move said piston from the OFF position to the ON position in which said chamber inlet and chamber outlet are substantially unobstructed.

17. The system of claim 16, wherein said valve means further includes means for spring biasing said piston to the OFF position.

18. The system of claim 16, wherein said auxiliary pilot valve means further includes a manifold surface with three non-colinear juxtaposed holes, duct means for connecting a first one of the holes to said municipal water supply inlet to said chamber and second and third holes to respective ends of said chamber, pivot body means having an elongated oval chamber with a sealing means along the periphery of the chamber in face-to-face contact with said manifold surface so as to encompass and communicate either said first and second holes or said first and third holes depending on whether said pivot body means is in an ON or an OFF angular position, and means responsive to said float level for rotating said pivot body to the ON position when said sump water exceeds the threshold or to the OFF position when said sump water falls substantially below said threshold.

19. The system of claim 18, wherein said valve means further includes means for maintaining said float at the ON position until the water level has dropped substantially below the normal buoyancy level of said float, whereby the pivot body is brought abruptly to the OFF position when the float drops.

* * * * *